US006247336B1

(12) United States Patent
Steinert

(10) Patent No.: US 6,247,336 B1
(45) Date of Patent: Jun. 19, 2001

(54) DEVICE FOR MEASURING THE DISTANCE BETWEEN THE DEVICE AND CLOTHING POINTS OF TRAVELING FLAT BARS

(75) Inventor: Thomas Steinert, Kempen (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 09/575,810

(22) Filed: May 22, 2000

(30) Foreign Application Priority Data

May 21, 1999 (DE) ..... 199 23 419

(51) Int. Cl.[7] ..... D01G 15/08; D01G 15/24
(52) U.S. Cl. ..... 66/102; 66/98
(58) Field of Search ..... 19/98, 102, 103, 19/104, 113, 112

(56) References Cited

U.S. PATENT DOCUMENTS 5,040,272 * 8/1991 Fritzsche ..... 19/104
5,398,381 * 3/1995 Schlichter et al. ..... 19/102
5,930,869 * 8/1999 Faas et al. .
6,085,390 * 7/2000 Leifeld ..... 19/113

FOREIGN PATENT DOCUMENTS 2 272 458 5/1994 (GB) .

* cited by examiner

*Primary Examiner*—Danny Worrell
(74) *Attorney, Agent, or Firm*—Venable; Gabor J. Kelemen

(57) ABSTRACT

A fiber processing machine includes a rotary roll provided with a peripheral clothing; a plurality of flat bars having a clothing cooperating with the roll clothing; and a sensor supported adjacent the flat bars and facing the flat bar clothing for determining a distance between said sensor and said flat bar clothing.

10 Claims, 4 Drawing Sheets

DEVICE FOR MEASURING THE DISTANCE BETWEEN THE DEVICE AND CLOTHING POINTS OF TRAVELING FLAT BARS

CROSS REFERENCE TO RELATED APPLICATION

This application claims the priority of German Application No. 199 23 419.1 filed May 21, 1999, which is incorporated herein by reference.

BACKGROUND OF THE INVENTION

This invention relates to a device provided in a fiber processing (spinning preparation) machine, for example, a carding machine, a cleaner or the like for measuring distances between facing surfaces. The machine has a clothed roll which cooperates with a clothed counter element, for example, a clothed flat bar. At least one stationary sensor is provided, by means of which the distance to a clothed surface may be determined.

The distance between the carding cylinder clothing and a facing component is of substantial significance as concerns the carding machine and properties of the fiber. The result of the carding process such as fiber cleaning, nep formation and fiber shortening is largely dependent from the carding gap, that is, the distance between the cylinder clothing and the clothing of the traveling flats or stationary carding elements. The channeling of air about the carding cylinder and heat removal are also dependent from the distance between the cylinder clothing and the clothed or unclothed surfaces, such as mote knife or housing shells. Such clearances are affected by various, partially counteracting factors. A wear of facing clothings leads to an enlargement of the carding gap which, in turn, results in an increase of the nep number and a decrease of the fiber shortening. An increase of the cylinder rpm, for example, for enhancing the cleaning effect, results in an enlargement of the cylinder including its clothing because of the centrifugal forces and thus diminishes the carding gap. Further, when large quantities of fiber or particular types of fiber, for example, chemical fibers are processed, the carding cylinder expands because of the temperature increase, resulting in a decrease of the distances of the cylinder clothing from adjoining components.

The carding clearance is affected particularly by the machine settings, on the one hand, and the condition of the clothing, on the other hand. The most important carding clearance of a card equipped with traveling flats is in the principal carding zone, that is, between the carding cylinder and the traveling flats assembly. Of the two clothings which define the carding clearance at least one is in motion (in most cases both are moving). To increase the output of the card, it has been desirable to select the operating rpm, that is, the operating speed of the movable elements, to be as high as permitted by the fiber processing technology. The working clearance is measured in the radial direction (starting from the rotary axis) of the carding cylinder.

In current carding processes increasingly larger fiber quantities per unit time are being handled, requiring higher speeds of the working components. Alone an increase of the fiber flow rate leads, because of the mechanical work, to an increased heat generation even if the working surface areas remain constant. At the same time, however, the technological carding results (uniformity of sliver, degree of cleaning, reduction of neps, etc.), are increasingly improved which requires larger working surfaces participating in the carding process and a closer setting of the components to the carding cylinder. The share of chemical fibers to be processed continuously increases. As compared to cotton, chemical fibers generate more heat due to their frictional contact with the working components of the fiber processing machine. In contemporary designs the working components of high-performance carding machines are enclosed from all sides in order to comply with the stringent safety requirements, to prevent particle emission into the spinning room and to minimize the maintenance requirements of the machines. Grates or even open, material-guiding surfaces which provide for an air exchange, belong to the past.

In view of the above-listed circumstances, the heat input into the fiber processing machine is significantly increased while the extent of heat removal by means of convection has been substantially reduced. The resulting significant heat-up of the high-performance carding machines leads to increased thermo-elastic deformations which, because of the non-uniform distribution of the temperature field, affect the set distances of the working components: the distances decrease between the carding cylinder and the traveling flat bars, the doffer, the stationary flat bars as well as the discharge locations. In an extreme case the set gap between the working components may completely disappear because of heat-caused expansions, so that relatively moving working components collide with one another. This results in significant damaging of the high-performance carding machine. Particularly the generation of heat in the working zone of the carding machine may lead to unlike thermal expansions between the structural components in case of excessive temperature differences.

In practice the quality of the clothing of the flat bar clothings is visually verified by an attendant at regular intervals; a wear results in an increase of the carding gap. In a known device, as disclosed in European patent document 801,158, a sensor is provided with which the working distance of carding clothings, that is, the carding gap may be measured. What is thus measured is the effective distance of the clothing points of one clothing between that of the facing clothing of the machine element. The machine element may have a clothing or may be formed by a housing shell segment having a guide surface. The sensor is conceived particularly for measuring the working distance between the carding cylinder and the flat bars of a traveling flats assembly where an optical device, positioned laterally, senses the carding clearance between the carding cylinder and the flat bar clothings. It is a disadvantage of such an arrangement that the change of the carding gap cannot lead to a conclusion whether or to what extent such change is caused by the wear of the clothing of the carding cylinder, the clothing of the flat bars or both.

SUMMARY OF THE INVENTION

It is an object of the invention to provide an improved device of the above-outlined type from which the discussed disadvantages are eliminated and which makes possible particularly the detection of wear of clothing points of travelling flats of a carding machine during operation thereof.

This object and others to become apparent as the specification progresses, are accomplished by the invention, according to which, briefly stated, the fiber processing machine includes a rotary roll provided with a peripheral clothing; a plurality of flat bars having a clothing cooperating with the roll clothing; and a sensor supported adjacent the flat bars and facing the flat bar clothing for determining a distance between said sensor and said flat bar clothing.

By the measures according to the invention a wear of the clothing of the traveling flat bars may be determined, particularly after a longer service period. Upon a change of the carding gap the effect of the change of the flat bar clothing is determined, directly with regard to the wear and also indirectly as concerns the change of the distance with respect to the carding cylinder. Particularly the wear of the cylinder clothing and expansions thereof due to temperature changes and centrifugal forces are established in this manner. As a result, based on a desired value, an optimal setting of the carding gap may be effected. Distance detection and adjustment may be performed during operation. It is a further advantage that the geometrically highest flat bar is found.

The invention has the following additional advantageous features:

The sensor is stationary during the sensing operation and, by distance detection, senses a wear or a shift of the flat bar clothing.

The sensor is an inductive or capacitive sensor and may be height-adjustable by a fine-threaded adjusting screw assembly which supports the sensor.

The distance measurements are utilized as input magnitudes for a control and regulating device to effect a distance regulation between the flat bar clothings on the one hand and the carding cylinder clothing, on the other hand.

The radial distance between the carding cylinder clothing and the flat bar clothing may be set by the shape and/or position of a flexible support strip mounted on a stationary mounting surface of the machine.

The electronic control and regulating device includes a memory for storing desired values for the distances.

A parameter (such as temperature) is measured which is related to the change of the working gap for producing a measuring value relating to the working gap.

DESCRIPTION OF THE PREFERRED EMBODIMENT

Figure 1:
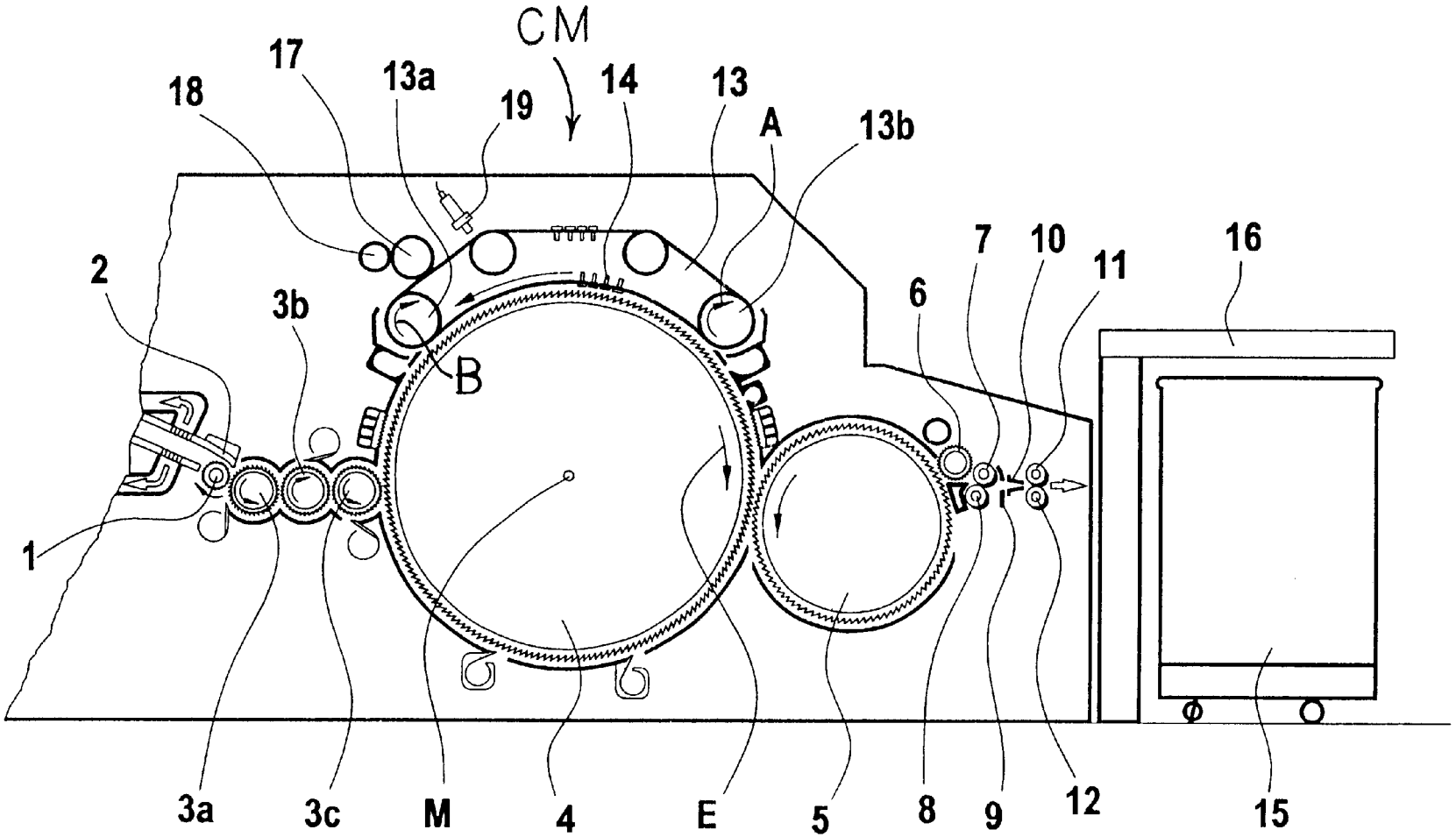
FIG. 1 is a schematic side elevational view of a carding machine incorporating the invention.

FIG. 1 shows a carding machine CM which may be, for example, an EXACTACARD DK 803 model, manufactured by Trützschler GmbH & Co. KG, Mönchengladbach, Germany. The carding machine CM has a feed roll 1, a feed table 2 cooperating therewith, licker-ins 3*a*, 3*b*, 3*c*, a carding cylinder 4 rotating in the direction E and having a rotary axis M, a doffer 5, a stripping roll 6, crushing rolls 7, 8, a web guide element 9, a sliver trumpet 10, calender rollers 11, 12, a travelling flats assembly 13 including end sprockets 13*a*, 13*b* (rotating in the directions B and A, respectively) and flat bars 14, a coiler can 5 and a coiler 16.

Figure 3:
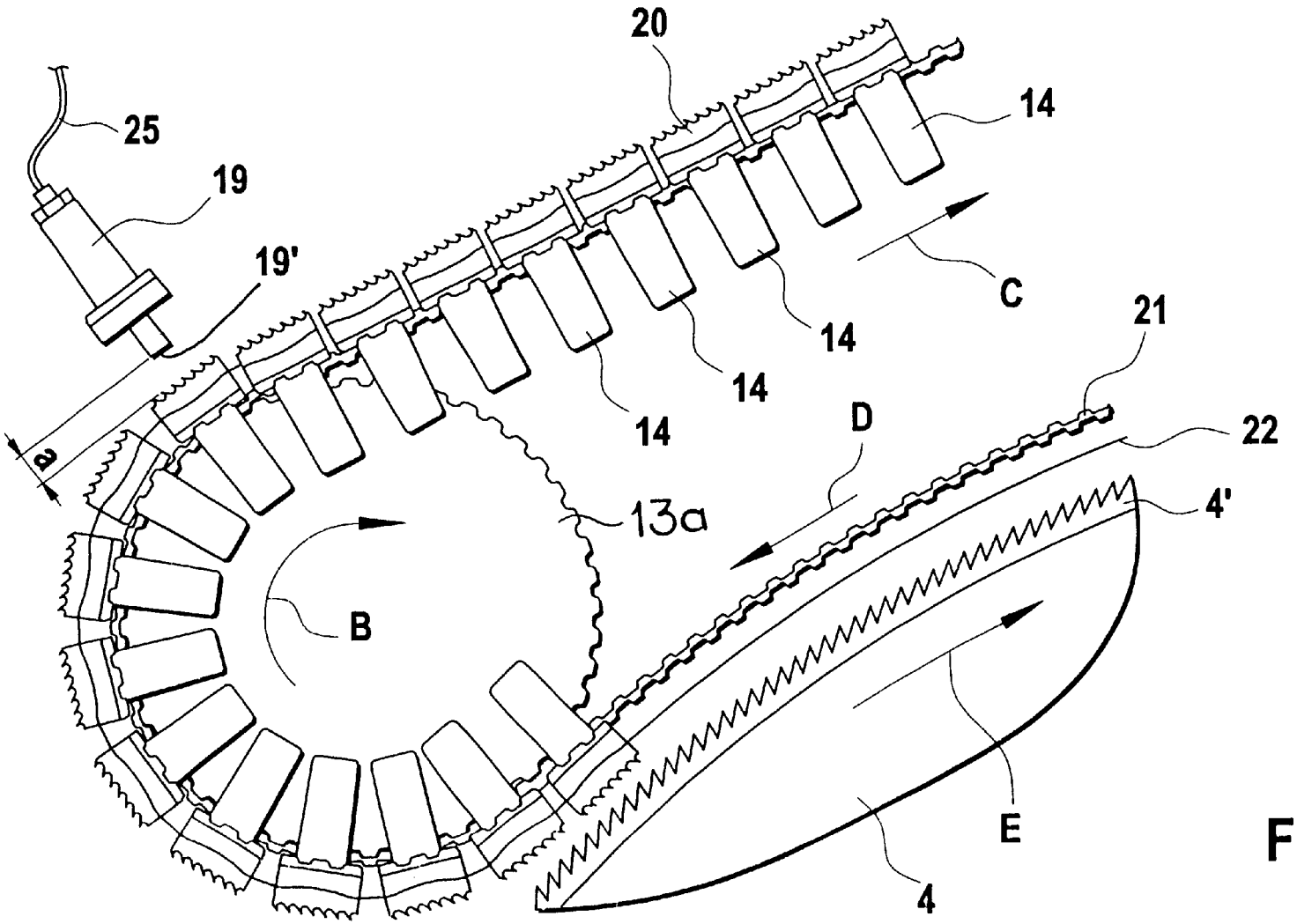
FIG. 3 is a schematic fragmentary side elevational view of the travelling flats assembly in the region of an end sprocket illustrating the device according to the invention.

Also referring to FIG. 3, the flat bars 14 are carried, with a low speed of 80–300 mm/min by an endless toothed belt 21 trained about the end sprockets 13*a*, 13*b*. The flat bars glide over slide guides 22 in the working zone with the carding cylinder 4. The flat bars 14 are carried in the direction of the arrow D through the working zone and, after being reversed by the end sprocket 13*a*, they return in an idling run in the direction of the arrow C. A stationarily supported sensor 19 (which may be a capacitive or an inductive sensor) is oriented towards the clothings of the consecutive flat bars 14 in their idling run in the region of the end sprocket 13*a*.

Figure 2:
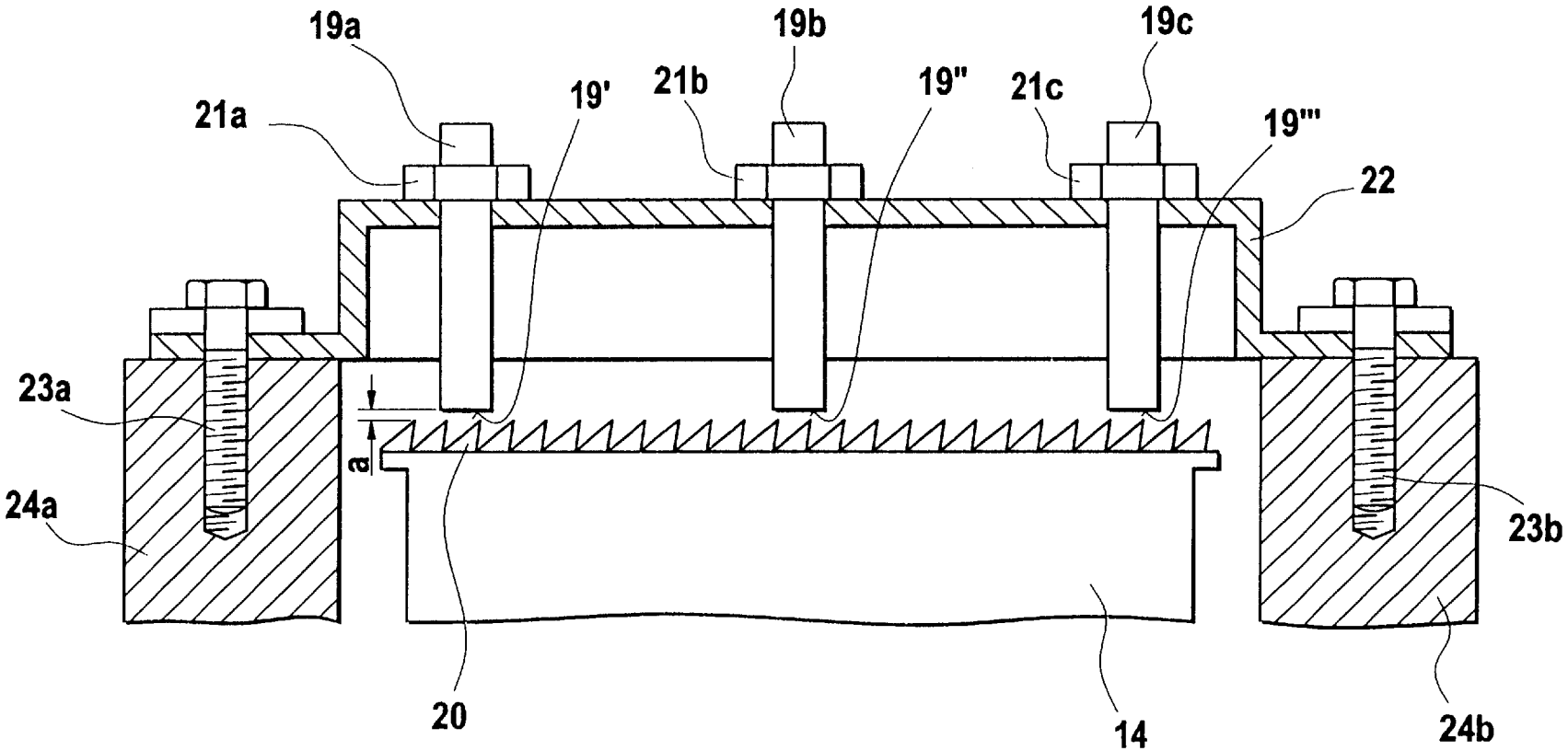
FIG. 2 is a schematic fragmentary front elevational view in section of a flat bar of a travelling flats assembly, incorporating the invention.

Turning to FIG. 2, three sensors 19*a*, 19*b* and 19*c* are arranged, spaced from one another, in a direction perpendicular to the travel direction of the flat bars 14. The respective sensor surfaces 19', 19" and 19'" are oriented towards the clothing 20 of the momentarily adjoining flat bar 14 and are spaced at a distance a from the clothing 20. Fine-threaded adjustment nuts 21*a*, 21*b* and 21*c* provide for a setting of the distance a for each sensor relative to the clothing 20. The sensors 19*a*, 19*b* and 19*c* are secured in a holding device 22 which is secured stationarily to the machine frame by screws 23*a* and 23*b*.

Figure 4:
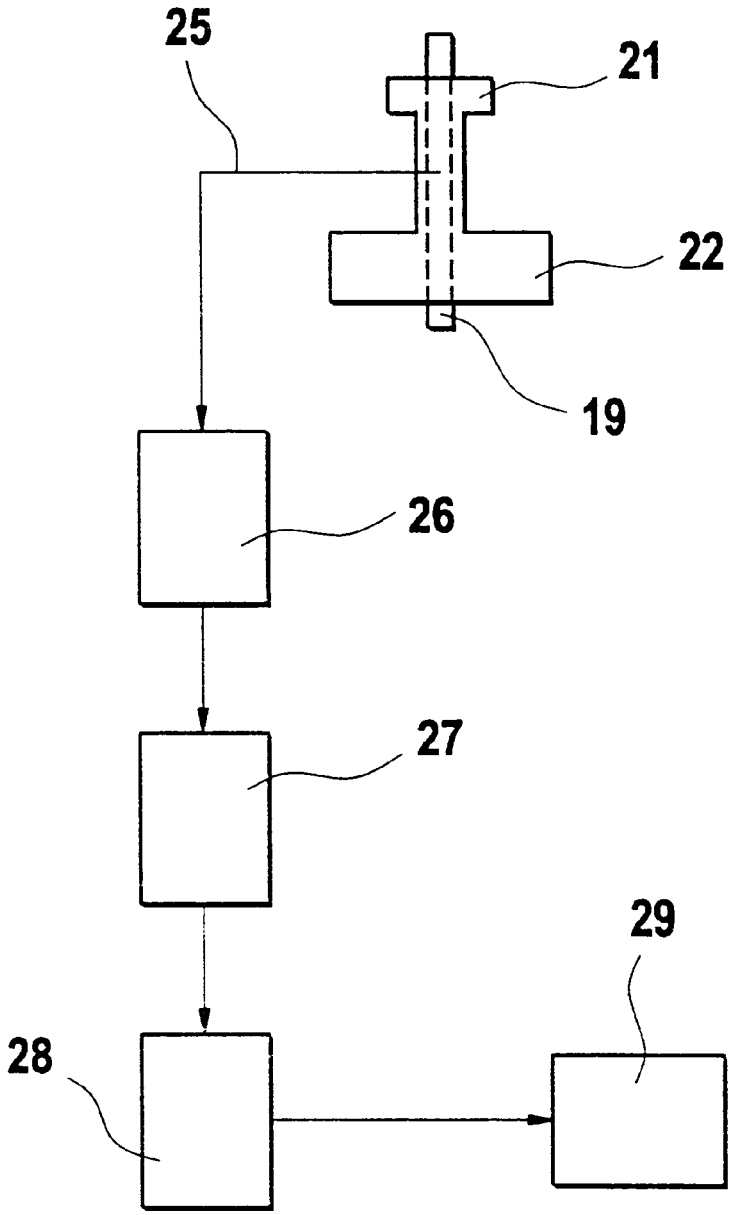
FIG. 4 is a block diagram of a control circuitry for adjusting carding components based on sensed data.

Turning to FIG. 4, an evaluating device 26 is connected to the sensor 19 by a conductor 25 and displays and stores the magnitudes detected by the sensor 19. The evaluating device 26 is further connected with an electronic card control device 27 which emits signals for the setting device 28 for adjusting the carding gap between the clothing 20 of the flat bars 19, on the one hand and the clothing 4' of the carding cylinder 4, on the other hand. At the same time, this information is also applied to a carding information system which may be a KIT model, manufactured by Trützschler GmbH & Co. KG and which forms part of a computer and display device 29 where the data of an entire carding group are monitored.

Structural features relating to mechanisms for adjusting the working distances, for example, by means of radially shifting the support for the slide guide 22 in the working zone as a function of sensor signals are disclosed, for example, in U.S. Pat. No. 5,918,349 which is incorporated herein by reference.

It will be understood that the above description of the present invention is susceptible to various modifications, changes and adaptations, and the same are intended to be comprehended within the meaning and range of equivalents of the appended claims.

What is claimed is:

1. A fiber processing machine comprising (a) a rotary roll provided with a peripheral clothing;

(b) a plurality of flat bars having a clothing cooperating with the roll clothing; and (c) a sensor supported adjacent the flat bars and facing the flat bar clothing for determining a distance between said sensor and said flat bar clothing;

said sensor being stationarily supported for sequentially facing the clothing of consecutive flat bars passing by said sensor.

2. The fiber processing machine as defined in claim 1, wherein said sensor is a capacitive sensor.

3. The fiber processing machine as defined in claim 1, wherein said sensor is an inductive sensor.

4. The fiber processing machine as defined in claim 1, further comprising a control and regulating device connected to said sensor for receiving signals therefrom representing said distance; and an adjusting device connected to said control and regulating device for displacing said rotary roll and said flat bars relative to one another to alter said spacing between said roll clothing and said flat bar clothing as a function of said signal.

5. The fiber processing machine as defined in claim 4, wherein said control and regulating device has a memory for storing data representing desired values of said distance.

6. The fiber processing machine as defined in claim 1, further comprising a traveling flats assembly; further wherein said flat bars form part of said traveling flats assembly.

7. The fiber processing machine as defined in claim 6, wherein said sensor is stationarily supported for sequentially facing the clothing of consecutive flat bars passing by said sensor.

8. A fiber processing machine comprising (a) a rotary roll provided with a peripheral clothing;

(b) a plurality of flat bars having a clothing cooperating with the roll clothing and having clothing points;

(c) a sensor having a measuring surface and being supported adjacent the flat bars and facing the flat bar clothing for determining a distance between said sensor and said flat bar clothing; and (d) means for measuring a distance between said measuring surface and said clothing points.

9. A fiber processing machine comprising (a) a rotary roll provided with a peripheral clothing;

(b) a traveling flats assembly;

(c) a plurality of flat bars having a clothing cooperating with the roll clothing; said flat bars forming part of said traveling flats assembly;

(d) a sensor supported adjacent the flat bars and facing the flat bar clothing for determining a distance between said sensor and said flat bar clothing;

(e) a support for positioning and stationarily supporting said sensor for sequentially facing the clothing of consecutive flat bars passing by said sensor; and (f) a fine adjusting means for adjusting a position of said sensor relative to said support and said flat bar clothing.

10. A fiber processing machine comprising (a) a rotary roll provided with a peripheral clothing;

(b) a traveling flats assembly including an endless belt for carrying said flat bars through a working zone and a return zone;

(b) a plurality of flat bars having a clothing cooperating with the roll clothing; said flat bars forming part of said traveling flats assembly; and (c) a sensor held adjacent the flat bars and facing the flat bar clothing for determining a distance between said sensor and said flat bar clothing; said sensor being stationarily supported for sequentially facing the clothing of consecutive flat bars passing by said sensor; said sensor measuring said distance during travel of said flat bars through said return zone.

* * * * *